US009842457B2

(12) United States Patent
Riggs et al.

(10) Patent No.: US 9,842,457 B2
(45) Date of Patent: Dec. 12, 2017

(54) METHOD, APPARATUS, AND PROGRAM PRODUCT FOR ALLOCATING PROGRESSIVE PRIZE POOLS

(71) Applicant: EVERI GAMES INC., Austin, TX (US)

(72) Inventors: Keith W. Riggs, Austin, TX (US); Paul Klingensmith, Austin, TX (US); Jim McHugh, Austin, TX (US); Lori Brooke, Austin, TX (US); Raymond Dumbeck, Austin, TX (US); Tushar Patel, Austin, TX (US)

(73) Assignee: Everi Games Inc., Austin, TX (US)

( * ) Notice: Subject to any disclaimer, the term of this patent is extended or adjusted under 35 U.S.C. 154(b) by 502 days.

(21) Appl. No.: 14/279,810

(22) Filed: May 16, 2014

(65) Prior Publication Data

US 2015/0332558 A1 Nov. 19, 2015

(51) Int. Cl.
*G07F 17/32* (2006.01)

(52) U.S. Cl.
CPC ..... *G07F 17/32* (2013.01); *G07F 17/3227* (2013.01); *G07F 17/3239* (2013.01); *G07F 17/3258* (2013.01)

(58) Field of Classification Search
CPC ..... G07F 17/3258; G07F 17/3244
USPC ..... 463/16–20, 27
See application file for complete search history.

(56) References Cited

U.S. PATENT DOCUMENTS

| | | | | |
|---|---|---|---|---|
| 4,837,728 | A | 6/1989 | Barrie et al. | |
| 5,655,961 | A | 8/1997 | Acres et al. | |
| 6,110,043 | A | 8/2000 | Olsen | |
| 6,146,273 | A | 11/2000 | Olsen | |
| 6,210,275 | B1 | 4/2001 | Olsen | |
| 7,297,059 | B2 | 11/2007 | Vancura et al. | |
| 7,357,716 | B2 | 4/2008 | Marks et al. | |
| 7,410,421 | B2 | 8/2008 | Mathis | |
| 7,568,973 | B2 | 8/2009 | Iddings et al. | |
| 7,578,739 | B2 | 8/2009 | Gauselmann | |
| 7,585,223 | B2 | 9/2009 | Iddings et al. | |
| 7,780,523 | B2 | 8/2010 | Baerlocher et al. | |
| 7,841,939 | B2 | 11/2010 | Baerlocher et al. | |
| 7,862,427 | B2 | 1/2011 | Nguyen et al. | |
| 2006/0246979 | A1* | 11/2006 | Chim | G07F 17/3267 463/13 |
| 2008/0125211 | A1* | 5/2008 | Plowman | G07F 17/3258 463/20 |
| 2009/0131145 | A1* | 5/2009 | Aoki | G07F 17/3211 463/20 |
| 2009/0191954 | A1* | 7/2009 | Ly | G06F 11/2038 463/25 |

(Continued)

*Primary Examiner* — Michael Cuff
(74) *Attorney, Agent, or Firm* — Nathan Calvert, Esq.; Russell D. Culbertson, Esq.; J.P. Cody, Esq.

(57) ABSTRACT

A method for controlling contributions to progressive prize pools includes providing a progressive server which manages standalone progressive prize pools for each of multiple individual gaming machines. The progressive server may further provide group progressive prize pools, allowing a gaming machine to have standalone pools and also be a member in a group pool. Where multiple standalone progressive prize pools are maintained for a single gaming machine, additional steps are taken to identify which pool or pools are to be increased when a standalone progressive contribution is made.

18 Claims, 5 Drawing Sheets

(56) References Cited

U.S. PATENT DOCUMENTS

| | | | | |
|---|---|---|---|---|
| 2010/0062843 | A1* | 3/2010 | Gagner | G07F 17/3202 463/27 |
| 2012/0115580 | A1* | 5/2012 | Hornik | G07F 17/34 463/25 |
| 2012/0252562 | A1 | 10/2012 | Aoki | |
| 2014/0045580 | A1* | 2/2014 | Hawkins | G07F 17/3244 463/25 |
| 2014/0274299 | A1* | 9/2014 | Kitamura | G07F 17/34 463/20 |
| 2014/0274349 | A1* | 9/2014 | Spencer | G07F 17/3258 463/27 |
| 2015/0065234 | A1* | 3/2015 | Watkins | G07F 17/3258 463/27 |

* cited by examiner

METHOD, APPARATUS, AND PROGRAM PRODUCT FOR ALLOCATING PROGRESSIVE PRIZE POOLS

TECHNICAL FIELD OF THE INVENTION

The invention relates to wagering games which offer one or more progressive prizes. More particularly, the invention provides a method, gaming apparatus, and program product which controls the contributions to one or more standalone progressive prize pools so as to increase player interest and excitement during the course of play in the wagering games eligible for prizes from the one or more progressive prize pools.

BACKGROUND OF THE INVENTION

Wagering games commonly provide prizes based on a predefined pay table. Prizes based on a predefined pay table equate a graphically represented result in the wagering game with a pay table prize defined for that result. In the case of reel-type wagering games in which results are displayed through symbol combinations shown on a series of mechanical or video-generated spinnable reels which have each been stopped at a particular angular orientation, a symbol combination shown on the stopped reels such as a line of three of the same symbol may be shown in a pay table for the game as correlating to a prize in currency, credits, or other value. In the example of a playing card game such as a video poker game, a pay table for the game may equate various playing card hands to a respective prize value which is paid to the player upon achieving the respective hand in a play of the game.

In addition to or in lieu of prizes based on a predefined pay table, wagering games may also provide progressive prizes. Progressive prizes often do not have a fixed value. These types of prizes have typically been funded by a certain percentage of each qualifying wager placed in a given wagering game and perhaps other wagering games that are linked for the progressive prizes. For example, 1% of each wager placed at a given gaming machine may be allocated to a progressive prize pool. Thus for every one dollar wager placed at such a gaming machine, the progressive prize pool is incremented by one cent. All or some fraction of the amount accumulated in the progressive pool may be awarded to a player in response to a progressive prize winning event in the progressive game system. The progressive prize winning event may be a particular triggering result in a wagering game operated by the player or may be defined in any other suitable manner. Once the progressive prize is awarded from the progressive pool, the amount of the prize is deducted from the pool value and the pool may be reset at some minimum value by adding a progressive prize seed value which may be funded by the progressive system operator. In some jurisdictions, a type of progressive known as standalone progressives is allowed, in which a single game machine contributes to one or more standalone progressive pools typically maintained at the gaming machine. The standalone machine also then controls the award of the standalone progressive pools.

The amount of the progressive prize awarded and the definition of the progressive prize winning event, or the triggering event, in the game may be related in some progressive gaming systems. For example, "must-hit-by" style progressive prizes are defined by an "award-at" value accumulated in a progressive pool, and the progressive prize winning event is defined as the play in the underlying wagering game which causes the progressive prize pool to reach that award-at value. This award-at value, which is concealed from the players, may be defined randomly within a certain range for the progressive prize pool. If a given wager in a participating game increments the accumulated value of the progressive prize pool to the defined award-at progressive prize value, the player making that wager wins the progressive prize amounting to the award-at progressive prize value.

Progressive prize gaming systems may maintain multiple different progressive prize pools, each providing a different progressive prize. Different progressive prize pools are commonly defined as different tiers at different maximum values. A wager in a participating game may be used to increment the value of some subset of the progressive prize pools or all of the progressive prize pools.

Progressive prizes have been popular among casino patrons for a number of reasons. One reason for the popularity is that a large number of gaming machines, perhaps even located at different gaming facilities, may be linked to accumulate the progressive prize pool or pools. Collecting contributions from a large number of gaming machines allows the progressive prize pools to collect large values, and thus progressive prizes may be very large, commonly much larger than prizes in the predefined pay tables for the underlying wagering games. However, despite the popularity of progressive prizes and the progressive gaming systems that offer such prizes, there remains a need in the gaming industry to devise new types of progressive gaming systems and methods to capture and hold player interest.

SUMMARY OF THE INVENTION

The invention encompasses methods, apparatus, and program products for controlling contributions to standalone progressive prize pools in a fashion that increases player excitement and interest in the underlying wagering games utilizing the progressive prize pools. A progressive server provides capability to multiple gaming machines to have standalone progressive pools associated with each machine. In one version, a method for controlling contributions to one or more standalone progressive prize pools used for one or more wagering games includes receiving a play input for a wagering game and displaying a representation of the result for the play input. The play input will be associated with a wager for the wagering game, and the play input will typically be entered through a player input system associated with a gaming machine. Next the method determines whether a standalone progressive pool contribution is made for the given play input. This determination is made under control of the one or more data processing devices associated with a progressive server connected to the gaming machine through a network. Where a standalone progressive contribution is made for a play input, a contribution amount is then applied to increase at least one of the one or more standalone progressive prize pools associated with that single gaming machine only.

A method according to the present invention may also include awarding any prize associated with the result for the play input and awarding a progressive prize from at least one of the one or more progressive pools, the latter being responsive to a progressive prize triggering event in the single associated gaming machine for any particular standalone progressive pool. Both of these awarding steps are performed under control of the one or more data processing devices associated with the progressive server.

In some implementations of the present invention not all play inputs are eligible for providing a progressive pool contribution. Thus implementations of the invention may include determining if a given play input is eligible for providing a standalone progressive pool contribution, and the determination regarding whether a standalone progressive contribution event is triggered is made in response to a determination that the play input is eligible for providing a progressive pool contribution. It is noted that some versions may not include a standalone contribution with every qualifying wager, but instead may make further random or non-random determinations as to whether a contribution will be made for each particular wager. For example, one variation of the invention a given play input is eligible for providing a standalone progressive prize pool contribution when the result obtained for the play input is not associated with a prize, for example, when the result for the play input does not itself entitle the player to a prize according a pay table defined for the wagering game.

A gaming system according to one embodiment of the present invention includes a display system having at least one display device, a player input system, and at least one processor. One or more memory devices are associated with the processor or processors for storing instructions which are executable by the processor or processors to receive the play input for the wagering game through the player input system, and to cause the display system to display a representation of the result for the play input. The instructions may also be executable to, separately from the process of obtaining the result for the play input, determine whether a standalone progressive contribution event is required for the play input, and if so, to increase at least one of the one or more progressive prize pools by the contribution amount. Additional instructions may be stored which are executable to cause the display system to display an award of any prize associated with the result for the play input, and responsive to a progressive prize triggering event, cause the display system to display an award of a progressive prize from at least one of the one or more progressive pools.

It is understood that while generally in the art the term "progressive pool" or "progressive prize pool" refers to a tally or account to which multiple machines contribute (or "pool" their contributions), in the case of a standalone pool as used herein, the term means that one gaming machine or virtual gaming machine contributes to that pool.

Considering that the present invention may be implemented using one or more general purpose processing devices, the invention also encompasses program products which may each be stored on one or more tangible computer readable data storage devices representing non-transitory media. A program product according to the present invention may include programming on the gaming machine, on a gaming server, and on a progressive server.

These and other advantages and features of the invention will be apparent from the following description of illustrative embodiments, considered along with the accompanying drawings.

DETAILED DESCRIPTION OF ILLUSTRATIVE EMBODIMENTS

Figure 1:
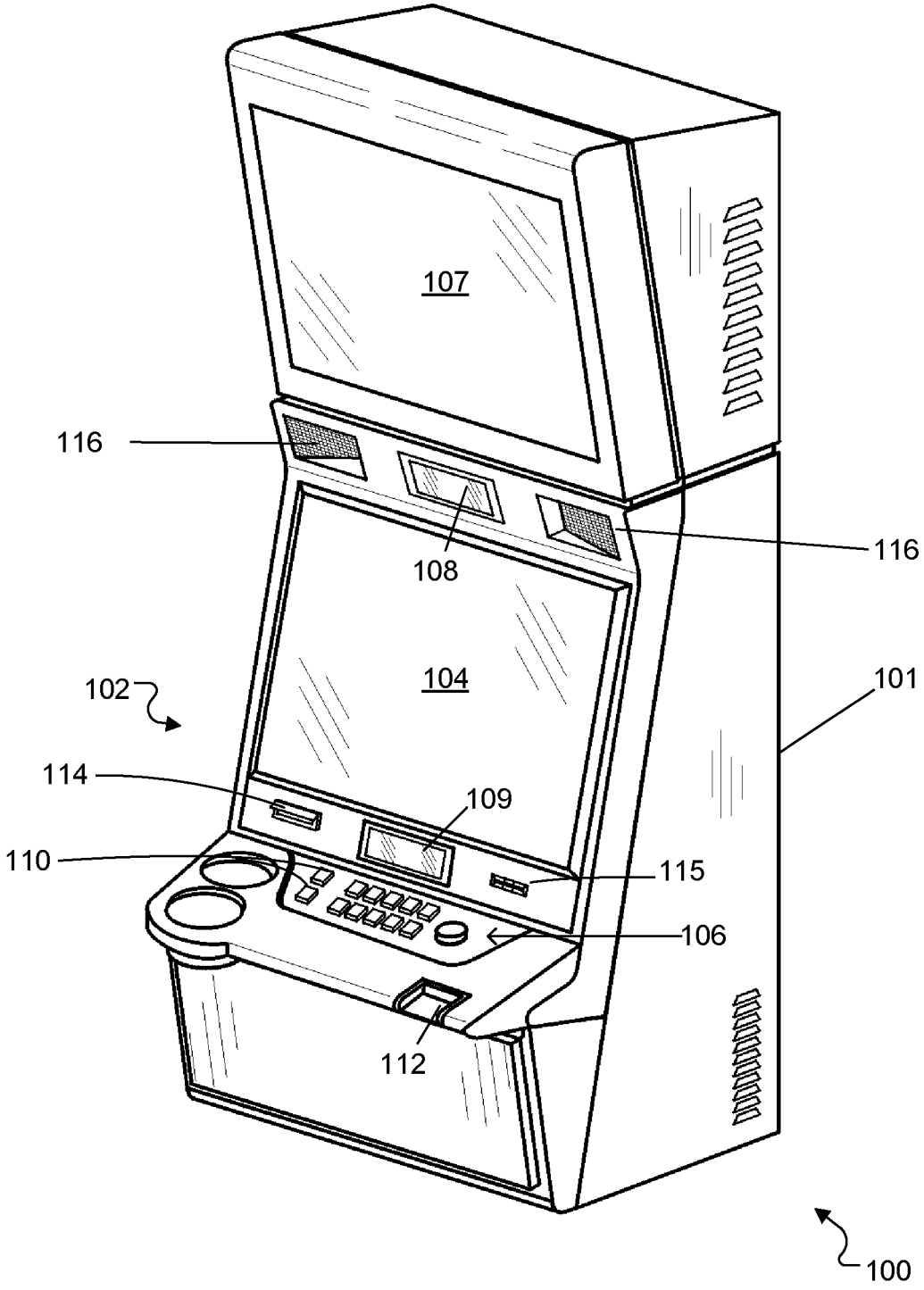
FIG. 1 is a view in perspective of a gaming machine which may be employed in embodiments of the present invention.
Figure 2:
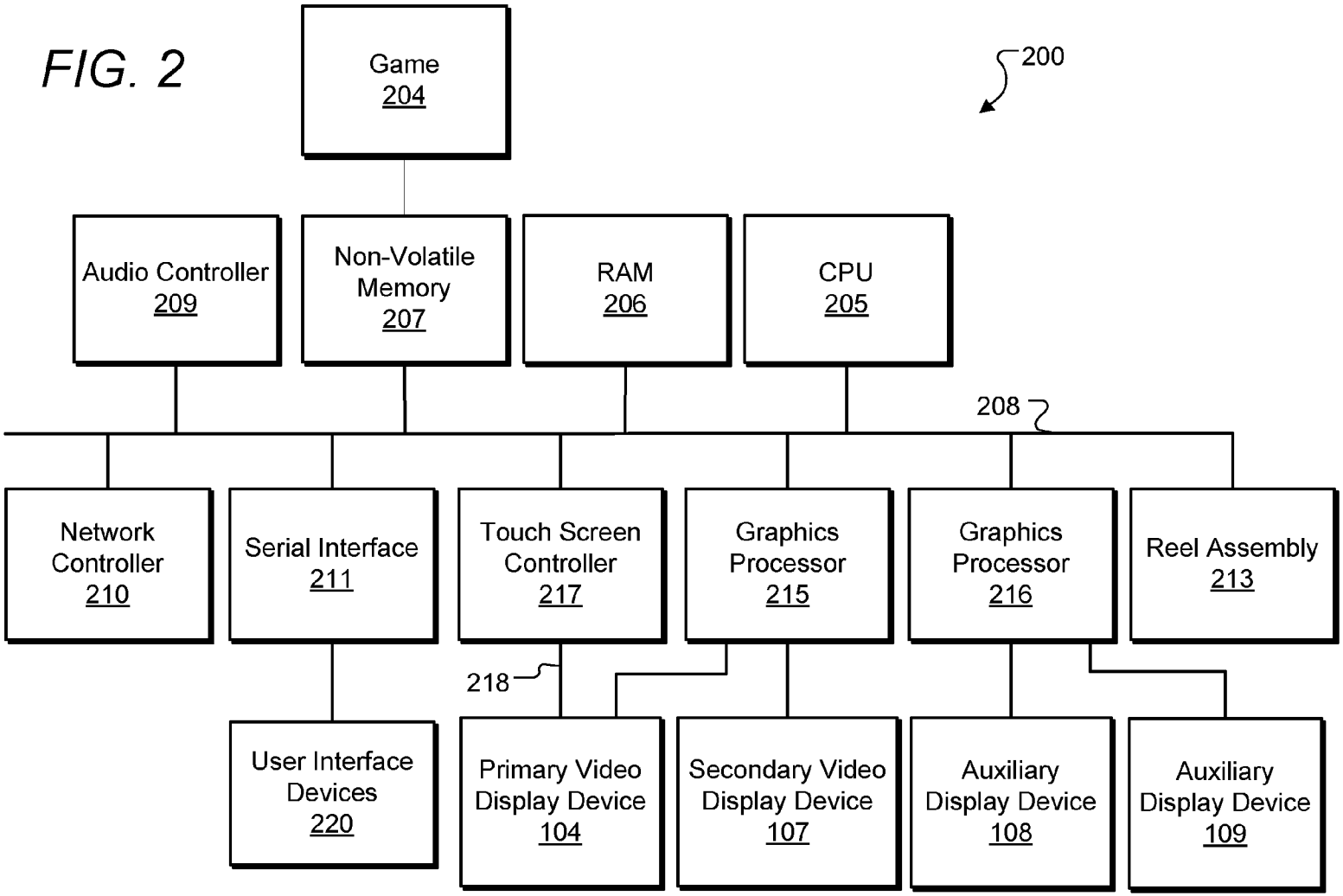
FIG. 2 is a diagrammatic representation of the gaming machine shown in FIG. 1 showing various components of the gaming machine.
Figure 3:
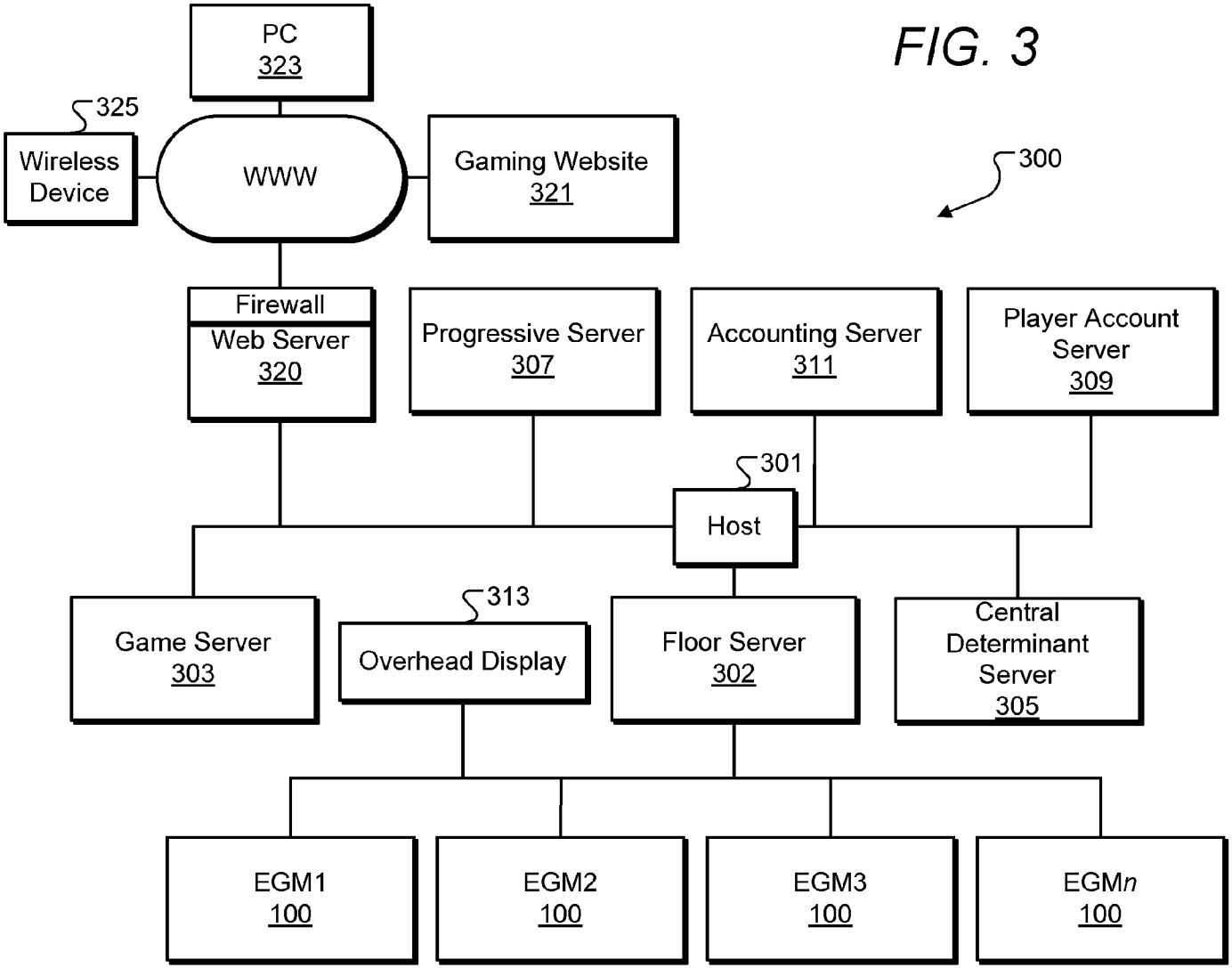
FIG. 3 is a diagrammatic representation of a gaming network in which the present invention may be implemented.

In the following description, FIGS. 1-3 will be used to describe example gaming machines and gaming networks through which the present invention may be implemented. Processes which are illustrative of various embodiments of the invention will then be described in connection with the flow chart of FIG. 4. FIG. 1 shows a gaming machine 100 that may be used in implementing a wagering game utilizing one or more progressive prize pools according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, with a button panel 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display game symbols which show the results for a given play of the game implemented through gaming machine 100. Such results may be shown by the manner in which game symbols are aligned along various paylines defined through a symbol location matrix presented by the display device 104. As will be described further below in connection with FIG. 2 and elsewhere, it is also possible for gaming machines within the scope of the present invention to include mechanical elements such as mechanical reels. One or more of the video display devices may also be used to show results in the form of a hand of playing cards, a dice roll, a horse race, or in any other fashion in which a result may be displayed. Generally, the display device or display devices of the gaming machine, whether video display devices, mechanical devices, or combinations of the two, which are used to display games according to embodiments of the invention, may be described in this disclosure and the accompanying claims as a display system.

The gaming machine 100 illustrated for purposes of example in FIG. 1 also includes a number of mechanical control buttons 110 mounted on button panel 106. These control buttons 110 may allow a player to select a bet level, select paylines, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls. The player interface devices which receive player inputs to initiate the play of a game through the gaming machine, such as controls to select a wager amount for a given play and controls to enter a play input to actually start a given play in the wagering game, may be referred to generally as a player input system.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

FIG. 2 shows a logical and hardware block diagram 200 of gaming machine 100 which includes a central processing unit (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG. 1). Thus the designation "gaming machine" encompasses both a standalone gaming machine and a gaming machine (that is, the part housed in a cabinet such as cabinet 101 in FIG. 1) along with one or more remote components for providing various functions (such as generating outcomes for plays in a game, and driving display devices mounted in a gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as program code 204 (which may include the player input program code, game program code, progressive pool program code, game payout program code, and progressive prize payout program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the invention may include mechanical reels. For example, a set of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 may be stored by a display controller or game processor 205 of the given gaming machine and transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the information to networked gaming machines 100 which present the games to players.

Progressive server 307 may maintain progressive pools according to the present invention, including standalone progressive pools and group progressive pools. Preferably, progressive server 307 may perform processes to participate in determining if a standalone progressive contribution is made for a given play input at a gaming machine 100, or in determining the contribution value. It may also determine an allocation between different standalone pools. Progressive server 307 maintains identifying information linking each gaming machine with its associated one or more standalone progressive pools in order to perform management and awards for the standalone pools. Progressive server 307 may also periodically communicate current standalone pool values back to the various gaming machines 100, and communicate awarded progressive prize amounts to the gaming machines and making adjustments to the standalone progressive prize pools accordingly. It is noted that, while standalone pools are the focus of the present disclosure, the progressive server may also maintain group pools as well, in which multiple gaming machines contribute to a common progressive pool in the well known manner. In some implementations, progressive server 307 may also determine or participate in determining when a standalone progressive prize triggering event occurs.

Accounting server 311 receives gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged onto website 321 the player may play various games on the website, including games offering standalone progressive prizes according to the invention in some cases. In such case, progressive server 307 may cooperate with web server 320 and game server 303 to maintain virtual instances of gaming machines that each have associated standalone progressive pool(s). Also website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network in which wagering games featuring standalone progressive prize pools according to embodiments of the present invention may be implemented, and is not intended to be limiting in any way. The invention is not limited to use in games offered through a gaming network (via the gaming website 321, or via gaming machines such as gaming machines 100, or otherwise). Also, where games including standalone progressive pool control as described herein are offered through a network-connected progressive serer, the network need not have the configuration shown for purposes of example in FIG. 3. In particular, servers shown separately in the example of FIG. 3 may be combined in a single physical processing device, or the processing duties of the various illustrated servers may be split into additional physical devices.

Figure 4:
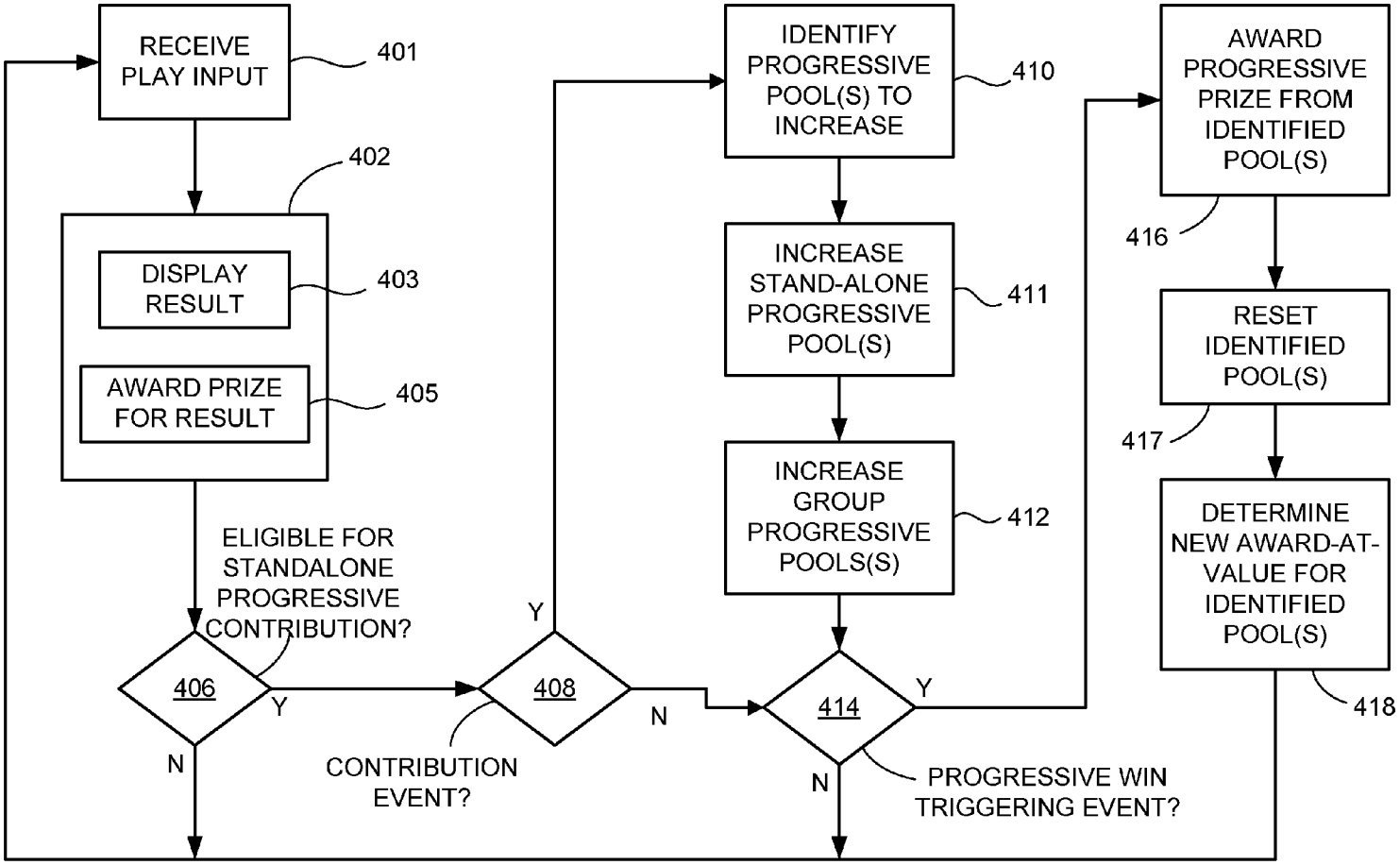
FIG. 4 is a flowchart illustrating a standalone progressive gaming process according to one or more embodiments of the present invention.

FIG. 4 is a flowchart showing an example stand-alone progressive pool control method according to various implementations of the invention. This example method includes first receiving a play input at a gaming machine as shown at process block 401. The method also includes conducting a game play sequence for the play input as shown at process block 402. In this case the game play sequence includes displaying a result for the play input at process block 403 and awarding a prize for the result at process block 405. As indicated by decision block 406, the illustrated method also includes making a determination as to whether the standalone progressive pools are eligible for standalone progressive contribution for that particular play input received at process block 401. In some cases, there is no separate determination of whether a contribution is made, and every wager eligible to contribute to the standalone progressive does so, but other cases include additional rules or decisions in the game math as to whether a contribution is made. If not, the process moves ahead to step 414. If it is determined that the progressive prize pools are eligible for stand-alone progressive contribution for that play input, it is determined whether a contribution event is triggered for that play input as indicated at decision block 408. However, if a contribution event is triggered as indicated by an affirmative outcome at decision block 408, the method includes identifying which progressive pool or pools to increase and identifying the contribution amount as shown at process block 410, and then increasing the identified standalone progressive pool or pools as indicated at process block 411. If group progressives are used in addition to the standalone progressives, a contribution is made there as well at step 412. Group progressives of various types are known and will not be further described here to avoid obscuring the relevant details.

The method illustrated in FIG. 4 next includes determining whether a progressive win triggering event has occurred as indicated by decision block 414. If there has been no progressive win triggering event, the process simply loops back to receive the next play input at process block 401. If a progressive win triggering event has occurred, the method includes awarding a progressive prize from the identified pool or pools as indicated at process block 416. The method also includes resetting the identified pool or pools as indicated at process block 417, and determining a new award-at value for the identified pool (for award-by type systems only) as indicated at process block 418. After this last determination the process loops back to receive the next play input at process block 401.

The process shown in FIG. 4 is specific to a particular play input received at a gaming machine for a wager which is potentially eligible to fund a standalone progressive pool and which is potentially eligible for a standalone progressive win. Thus at any point in time in a gaming system implementing the invention, a number of separate instances of this example process may be in progress, relating to individual gaming machines that have associated standalone progressive pools. Among these separate instances, the underlying wagering game for which the respective play input is received at process block 401 may be the same game or different games. For example, one of the wagering games contributing to a standalone progressive pool or pools may be a first type of reel-type (slot machine) game, while another one of the wagering games contributing to another instance of standalone progressive pool(s) may be a different type of reel-type game. Still other wagering games contributing to standalone progressive pool(s) may be video card games such as video poker, or any other type of game.

It should also be noted that the process shown in FIG. 4 omits an initialization step which is typically required before a gaming machine is in condition to receive a play input and also does not show a step of initializing the standalone progressive pool or pools affected by the process. Methods according to the invention may be employed in gaming systems that utilize any gaming machine initialization process. For example, it may be necessary for a player to log in at a given gaming machine using a player identifier or player card in order to place the gaming machine in condition to receive a game play input to initiate a play in the game. As another example, it may only be necessary for a player to insert cash into the gaming machine or insert a cash-in ticket or otherwise place value on the gaming machine (that is, in memory associated with the gaming machine) to place the gaming machine in condition to receive a game play input to initiate a play in the game. As for initializing the standalone progressive pool or pools, this may be accomplished in a gaming system employing methods according to the invention by setting the pool value to an initial seed value. For must-hit-by style progressive games the pool initialization step may also include determining an award-at value for each standalone pool in play. These steps of initializing the gaming machine and initializing the standalone progressive pools at the outset of play in the progressive gaming system are omitted from FIG. 4 so as not to obscure the invention in unnecessary detail.

The invention encompasses any arrangement by which a play input may be received as shown at process block 401 and any game sequence for that play input such as the example sequence shown at process block 402. A play input is commonly received through a player input system associated with the gaming machine such as one of the player interface devices 220 shown in FIG. 2. For example, a "PLAY" button on button panel 106 in FIG. 1 or a virtual "PLAY" button implemented on a touch screen associated with display device 104 in that Figure may be used to send a play input which is received by the gaming machine CPU 205 (FIG. 2). In any case, the play input will be associated with a wager for the respective play at the gaming machine. The wager may be expressed in terms of the credit value, monetary value, or in any other fashion, and may be selected separately from activating a "PLAY" button using wager level controls included on a player control button panel such as panel 106 in FIG. 1, or elsewhere on the gaming machine.

Although not shown in FIG. 4, the game sequence included at process block 402 may include a separate step of obtaining a game result in some fashion and then displaying the result as indicated at process block 403. Because a standalone progressive pool control system according to the present invention may be applied to class II and class III gaming systems, and any other gaming system which may provide standalone progressive prizes, obtaining a game result for the play input may be performed in any number of ways. For example, results may be obtained through a bingo game as in a class II gaming system, or may be obtained by drawing a lottery record as in some class III gaming systems. Alternatively, a result may be dictated by a number of elements randomly displayed as a result at process block 403 and then the result identified from evaluating that display. This latter arrangement for obtaining a result for the game input would be the case where the underlying game is a reel-type game utilizing independent random reel stops to identify a result for the play input. It should also be noted that the step of awarding a prize for the result for the given play input shown at process block 405 in FIG. 4 need not be performed immediately after displaying the result and before any of the other steps shown in the process. Rather, any prizes for a winning result for the play input may be awarded at any suitable point in the process such as part of an end play sequence prior to returning to receive the next play input at process block 401. In particular, the display at step 403 may be simultaneous with the display of the stand-alone progressive award if it is achieved. Regardless of when any prize is awarded for the result obtained for the play input, the prize may be awarded in cash, credits, physical objects, or in any other type of value or benefit. Where prizes for the game result are awarded in cash or credits, the prize may be awarded by incrementing a win or cash-out meter associated with the gaming machine. Of course, cash prizes and some other types of physical prizes may be dispensed by a suitable mechanism at the gaming machine, and large value prizes of any type may be awarded via a hand pay process as is known in the art.

The underlying game for which a play input is received at process block 401 in FIG. 4 may include displaying a single result for a base game, or may include displaying a result for one or more additional related games, such as secondary or bonus games. For example, a game play sequence such as that shown at process block 402 in FIG. 4 may include displaying results for one or more bonus games which are enabled based on the result in a base game or enabled in any other fashion. These secondary or bonus game results may be displayed as indicated at process block 403 or may be displayed at any other suitable point in the process shown in FIG. 4.

Although the process shown in FIG. 4 includes a separate step indicated at decision block 406 for determining whether the given play input is eligible for stand-alone progressive contribution, other forms of the invention may make all play inputs eligible for stand-alone progressive contribution. Where particular eligibility parameters must be met, any suitable parameter may be employed to determine eligibility. One preferred arrangement requires that the result displayed for the respective play input be a non-winning result that is not correlated to a prize in the underlying wagering game through a pay table for the underlying game or otherwise.

The process shown in FIG. 4 assumes that multiple different standalone progressive pools are being maintained by the system. Thus the method includes the step shown block 410 of identifying which progressive pool or pools to increase for the given play input. Any suitable process may be used to select the standalone progressive pool or pools to increase. For example the standalone progressive pool or pools may be selected randomly. Some forms of invention control the random process to provide a certain probability of increase for each pool on a given play input. It is also possible that an implementation of the present invention may maintain only a single standalone progressive pool from which standalone progressive prizes are awarded.

In some venues, existing gaming machines may be programmed to contribute only to group progressive pools using a game title identifier submitted to the progressive server with the progressive contribution. In such cases, a system may be reprogrammed by modifying the gaming machine originally programmed to provide a progressive contribution associated with a game title identifier to the progressive server. This may be done by replacing the DLL or function that reports wagers to the server (originally using the title identifier), with a function that receives the original parameters passed from the gaming software with a modified DLL or function that then replaces the title identifier with a unique gaming machine identifier, and then transmits the replaced data or calls the original unmodified DLL or function to communicate the contribution to the progressive server using the replaced value, thus enabling a standalone progressive pool for the gaming machine. The same is done when standalone progressive win events occur in such legacy systems. Of course, in systems that do not require retrofitting a group progressive pool system, a unique gaming machine identifier is communicated to the server from the gaming machine software for standalone progressive pool contributions and trigger events.

It is assumed in the process shown in FIG. 4 that the contribution amount, that is, the amount by which the identified progressive pool is increased for a given play input, varies in some fashion. Thus the process includes the step of identifying the contribution amount at process block 411. It should be appreciated that other forms of the invention may utilize a static contribution amount. In forms of the invention that require the contribution amount identifying step, any suitable method may be used to identify the contribution amount. Some preferred forms of the invention identify the contribution amount randomly using a random number generator in a process similar to that described above in connection with decision block 408. In this random contribution amount identification case, the process may be devised so as to ensure a desired distribution of contribution amounts which may be identified and a desired probability of selections associated with each potential contribution amount. The amount of the contribution may be in units of currency (pennies for example), or may be a percentage of the wager associated with the given play input received at process block 401, or may be defined in any suitable fashion. It will be appreciated that the contribution amount will commonly be limited to provide a desired overall payout for the gaming system including both payouts for the results displayed as shown at process block 403 and standalone progressive wins awarded as shown at process block 416.

Regardless of how the standalone progressive pool or pools are identified for a given increase and the amount of the increase, a method according to the invention will include increasing the identified standalone progressive pool or pools as shown at process block 411. The value of each standalone progressive pool may be maintained by a virtual or other meter which is linked at the progressive server to the associated single gaming machine preferably using a gaming machine identifier, either directly or indirectly, and is incremented by the desired contribution amount to increase the respective pool. Such a standalone progressive pool meter for a respective pool is maintained at a server such as progressive server 307 shown in FIG. 3.

As noted above, implementations of the invention are not limited to any particular progressive win triggering event. The process conducted at decision block 414 to determine whether a progressive prize is triggered will typically be dependent upon how the progressive prize is triggered. For example, where a progressive prize is triggered randomly, the process may include drawing a random number from a range of numbers and comparing that drawn number to a subset of numbers in the overall range selected to provide a desired probability of triggering the progressive prize. In versions that employ a must-hit-by progressive system, step 414 may comprise comparing the current value of a respective progressive pool after the increase indicated at process block 411 to a predetermined award-at value for the respective progressive pool. This comparison may be made at the gaming machine which received the play input as indicated at process block 401 or may be made at a progressive game server such as server 307 shown in FIG. 3, or some other server. As another example, a progressive prize triggering event may be defined as a certain number of plays of the underlying game or games. In this case the number of plays may be determined randomly and the process required for decision block 414 may be a comparison of a running count of game plays to the randomly determined value. As yet another example, a progressive win may be defined by some event in the gaming system. The occurrence of such an event may be indicated by setting a bit in a register, and the inquiry required at decision block 414 may include simply checking the status of that bit.

The step of awarding the progressive prize may include reducing or decrementing the identified pool or pools by the amount of the progressive prize being awarded. Where each pool value is maintained by a suitable virtual or hardware meter, the meter value may simply be decremented by the value of the progressive prize. This amount decremented from the identified pool or pools may be awarded to the player in any suitable manner. In some cases, the amount may simply be credited to a win or cash-out meter for the player at the particular gaming machine. Other gaming systems may require a hand pay to pay a progressive prize. This is particularly the case when the progressive prize is a large value prize. The value of the standalone progressive prize awarded for a given standalone progressive prize triggering event may be the entire value of the respective standalone progressive pool or pools from which the progressive prize is paid. In other cases, the standalone progressive prize for a given standalone progressive prize triggering event may be defined as a certain percentage of the current pool value, defined as some fixed amount, or may be defined as some variable amount which varies according to one or more parameters. The value of a given standalone progressive prize may also be determined randomly at any suitable point in the process shown as an example in FIG. 4.

The step of resetting the identified standalone pools at process block 417 may reset each pool from which a progressive prize is awarded to some minimum value for that standalone pool. The amount needed to reset the pool at the minimum value may be provided in any suitable manner and will typically be advanced by the casino operator or progressive game operator. For example, where the progressive prize reduced the respective progressive pool to zero, the operating casino may advance an amount to increase the value of that standalone progressive pool from zero to the minimum value for the pool. From that reset value, the standalone pool may be incremented randomly according to the invention until another progressive win triggering event for that respective standalone pool.

Determining a new award-at value for the identified standalone pool at process block 418 may be performed in any suitable manner at any processing device included in the gaming system. This step may be performed at a processor associated with progressive game server 307 in FIG. 3. In one implementation, a given standalone progressive prize is defined as having a minimum value and a maximum value, and the award-at value for that pool is then determined in a random process as some value between the minimum and maximum. The random process may be controlled such that relatively higher award-at values may be determined in a given instance of the process. Regardless of how the award-at value is determined at process block 418, that value may be used in determining whether a progressive win event has occurred as discussed above in connection with decision block 414.

Although the process shown in FIG. 4 is specific to a must-hit-by style progressive gaming system, and thus includes determining a new award-at value as indicated at process block 418, the invention is not necessarily limited to this style of standalone progressive gaming system. Rather, the standalone progressive system herein is applicable to any progressive gaming system regardless of how the value of the standalone progressive prize is determined and regardless of what constitutes a standalone progressive win triggering event. For example, although the standalone progressive win triggering event for the process shown in FIG. 4 may be reaching the current award-at value for a given standalone progressive pool, other implementations of the invention may trigger progressive prizes based on the result displayed for the play input as shown at process block 403, may trigger standalone progressive prizes randomly regardless of the result for the play input, or in any other fashion.

As is apparent from the previous discussion, the invention is not limited to a single standalone progressive pool. Rather, two or more standalone progressive pools may be maintained in play for a given gaming machine. In one implementation, three different standalone progressive pools are all maintained for each machine entered in the system, and a standalone progressive prize may be awarded from any one of the pools on any given play in one of the underlying wagering games. Where multiple standalone progressive pools are maintained in the progressive gaming system, each standalone progressive pool may have a different minimum and maximum value.

In some forms of the invention the play input received at process block 401 in FIG. 4 may be associated with any one of the several different wager levels defined for the particular wagering game. Where different wager levels are available to the player, certain decisions and processes according to the present invention may be dependent in some fashion on the particular wager level. Also the step of identifying the progressive pool to increase and identifying the contribution amount as indicated at process block 410 may also be dependent upon the wager level for the given play input. In this way, all wager levels can be eligible for the progressive prizes, but higher wager levels may afford more lucrative contribution parameters for the standalone progressive pools to give equitable pay percentage value for higher wagers, or even a higher pay percentage for higher wagers.

Figure 5:
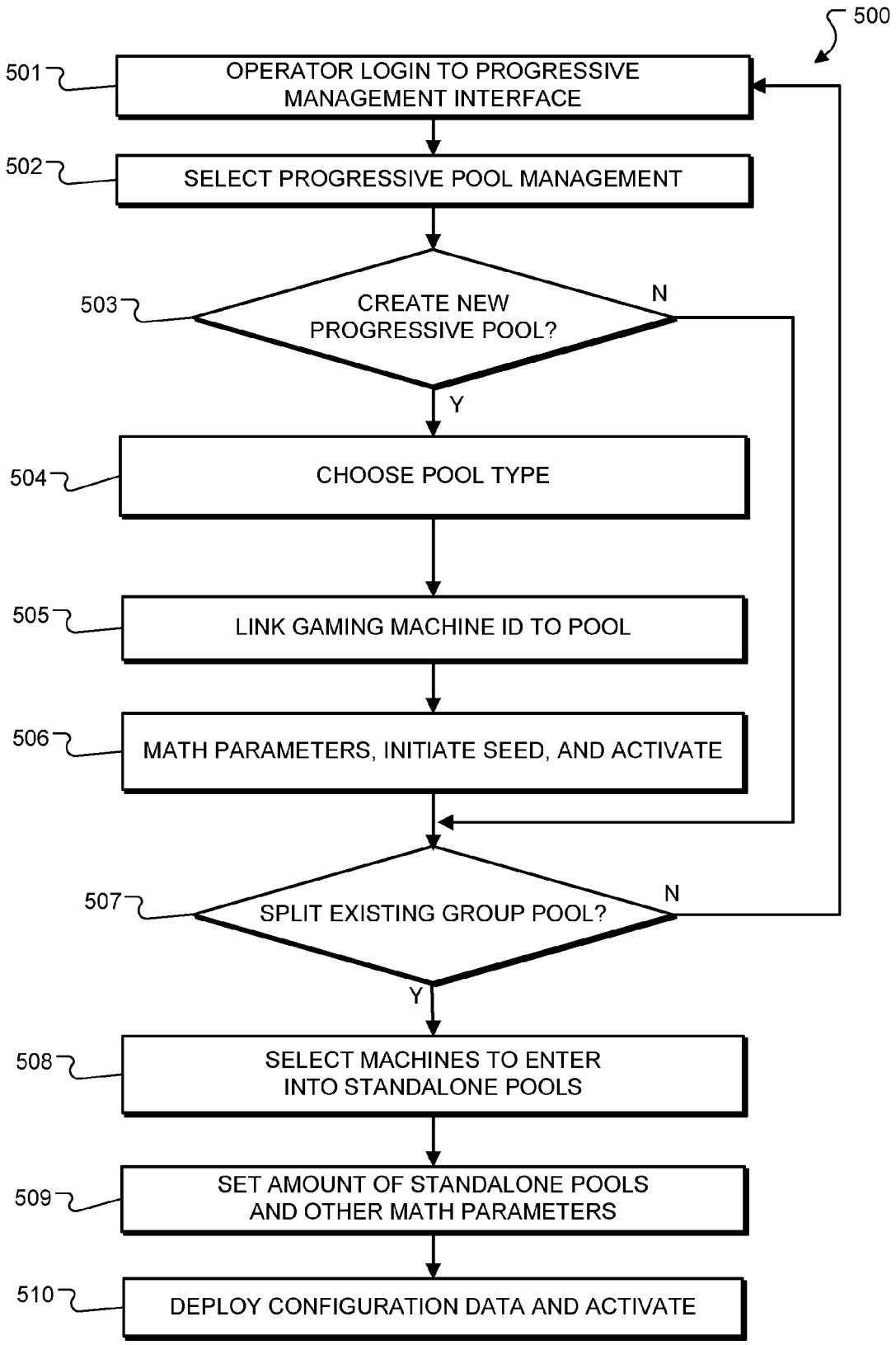
FIG. 5 is a flowchart illustrating a standalone progressive game management process according to one embodiment of the present invention.

FIG. 5 is a flowchart illustrating a standalone progressive game management process according to one embodiment of the present invention. The depicted process 500 shows steps an administrative operator takes to create standalone progressive pools according to various embodiments. In step 501, the operator logs into the management interface, which is preferably presented as a web interface by the progressive server, but may be presented by another management server with resulting configuration data or files being transferred to the affected progressive server and gaming machines. At step 503, the operator selects the progressive pool management interface, which presents many options for tracking and managing the standalone and group progressives discussed herein. If the operator selects an option to create a new pool at step 504, the process creates a new pool record and allows the operator to select the pool type, which may include group or standalone, as well as denomination and a tier level if the progressive pool is to be deployed in a multiple pool game. After determining the type of pool involved, the operator at step 505 selects the gaming machine ID(s) to which the pool will be linked. A standalone progressive pool created through this process may only be linked to a single gaming machine as discussed above. Group progressive pools require at least two gaming machines, and are typically selected by the game title which the specified group of gaming machines is providing on the gaming venue floor. Next at step 506, the operator sets the initial seed amount of the pool, and other mathematical parameters needed to activate the pool such as must-hit-by value, maximum value, win events, and wager contribution information, for example. To activate at this step, the gaming machine must also be configured with the parameters for wager contribution and win events, together with the appropriate display information for integrating the standalone progressive pool into the game(s) provided by the gaming machine.

The progressive server control interface may also provide ability to split an existing group progressive pool and make the funds in that pool available to seed or convert to multiple standalone pools. Typically such a split would provide a standalone pool at each of the machines previously contributing to the group progressive pool being split. If the option is selected to split an identified existing pool at step 507, the operator next selects machines to be linked to the respective multiple standalone pools created by the split at step 508. Following that, at step 509, the operator sets the amounts to be allocated to each standalone progressive pool, which may not always be equal if tiered standalone pools are being deployed, with two or more standalone pools assigned to each gaming machine. At step 509 the operator also selects or enters the remaining configuration data discussed above, such as seed value (to be used to reseed the pool after it is awarded) and maximum value, win events, and wager contribution information, etc. Finally at step 510 the operator deploys and activates the multiple standalone pools created by the split, by saving the configuration data to the progressive server and the gaming machines which are to be linked to the standalone pools.

The configuration interface functions described above are merely one example of a configuration process to deploy and use standalone progressive pools together with group progressive pools according to some embodiments of the invention. It should be understood that many different methods may be used to configure gaming machines and progressive servers to achieve the results described herein, depending on the deployment situation and the existing platform to which standalone progressive pools are deployed according to the various techniques described herein.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for controlling contributions to multiple progressive prize pools used for multiple gaming machines connected to a gaming network, the method including:

under control of the one or more data processing devices associated with the progressive server, providing an operator interface with an option to configure each of multiple unique gaming machines having a game with a group identifier not unique among the multiple unique gaming machines, associating a respective identifier for the game title of each of the multiple unique gaming machines with a respective one of multiple group progressive prize pools, each of the multiple progressive prize pools thereby being linked to at least two of the multiple unique gaming machines;

under control of the one or more data processing devices associated with the progressive server, providing an operator interface with an option to convert two or more of the multiple unique gaming machines to standalone progressive functionality by associating unique identifiers for at least two of the multiple unique gaming machines with a respective one or more of multiple standalone progressive prize pools; and then, for a selected gaming machine of the two or more multiple unique gaming machines:

(a) receiving a player input from a currency or credit acceptor or player card reader of the gaming machine, and in response activating a credit meter showing player credits to be wagered, receiving a play input for a wagering game through a player input system of the gaming machine, the player input being associated with a wager for the wagering game;

(b) under control of one or more data processing devices associated with the gaming machine, causing a result display system of the gaming machine to display a representation of a result for the play input;

(c) under control of the one or more data processing devices associated with the progressive server, and separately from a process of obtaining the result for the play input, determining whether a standalone progressive contribution event is required for the play input;

(d) if the standalone progressive contribution event is required for the play input, applying a respective contribution amount to increase at least one of the one or more standalone progressive prize pools;

(e) under control of the one or more data processing devices associated with the gaming machine, awarding any prize associated with the result for the play input; and (f) under control of the one or more data processing devices associated with the progressive server, awarding a standalone progressive prize on the credit meter from at least one of the one or more standalone progressive prize pools responsive to the occurrence of a standalone progressive prize triggering event.

2. The method of claim 1, wherein the progressive server further controls a contribution from the wager to at least one group progressive prize pool.

3. The method of claim 1 wherein the one or more standalone progressive prize pools include at least two different standalone progressive prize pools and further including, under the control of the one or more processing devices associated with the progressive server, identifying which of the at least two different standalone progressive prize pools are to be increased for the play input.

4. The method of claim 3 further including determining if the wager is at a first wager level defined for the wagering game or is at a second wager level defined for the wagering game, the second wager level being different from the first wager level, and choosing which of the at least two standalone progressive prize pools is to be increased based upon which wager level is determined.

5. The method of claim 1 wherein a contribution apportionment for the play input determines an apportionment of the respective contribution amount for increasing at least two standalone progressive prize pools for that play input.

6. The method of claim 1, further comprising presenting a control user interface allowing an operator to create at least two standalone progressive prize pools associated with at least two respective individual gaming machines by splitting an existing group progressive prize pool.

7. The method of claim 1, in which converting two or more gaming machines to standalone functionality further comprises retrofitting a gaming machine originally programmed to provide a progressive contribution associated with a group identifier to the progressive server, to provide a modified executable code routine in place of an original executable code routine designed to report wager contributions to, when reporting, change the group identifier to be a unique gaming machine identifier, enabling a standalone progressive prize pool for the gaming machine.

8. A networked gaming system for controlling contributions to one or more progressive prize pools used for one or more wagering games, the system including:

(a) multiple unique gaming machines each including a display system, at least one gaming processor and at least one memory device, player interface controls, and a currency/credit acceptor or player card reader operable to receive a player input, and in response activate a credit meter showing player credits to be wagered;

(b) a progressive server including at least one processor and at least one memory device storing instructions executable by the at least one processor to: (i) provide an operator interface with an option to configure each of the multiple unique gaming machines having a game with a group identifier not unique among the multiple unique gaming machines, associating a respective identifier for the group identifier of each of the multiple unique gaming machines with a respective one of multiple group progressive prize pools, each of the multiple progressive prize pools thereby being linked to at least two of the multiple unique gaming machines; and (ii) provide an operator interface with an option to convert two or more gaming machines to standalone progressive functionality by associating identifiers for two or more of the multiple unique gaming machines with respective ones of multiple standalone progressive prize pools;

(c) program code stored on one of the memory devices and executable by the least one gaming processor or the at least one progressive server processor to:

(i) associate an identifier for a single unique gaming machine with one or more standalone progressive prize pools;

(ii) activate a player wager of credits as a result of a player input at one of the gaming machines and determine whether a standalone progressive contribution event is required for the player wager;

(iii) where the standalone progressive contribution event is required for the play input, applying a respective contribution amount to increase at least one of the one or more standalone progressive prize pools;

(iv) under control of the one or more data processing devices associated with the gaming machine, awarding any prize associated with the result for the play input; and (v) under control of the one or more data processing devices associated with the progressive server, awarding a standalone progressive prize and crediting it to the credit meter from at least one of the one or more standalone progressive prize pools responsive to the occurrence of a standalone progressive prize triggering event.

9. The networked gaming system of claim 8, further comprising a central determinant server communicatively coupled to the multiple unique gaming machines and programmed to provide gaming outcomes to the multiple unique gaming machines, and wherein the progressive server is programmed maintaining one or more standalone progressive pools associated with a respective one of the unique gaming machines, wherein maintaining standalone progressive pools includes accepting contributions to said associated pools solely from the respective unique gaming machine, and making payouts solely to the respective unique gaming machine from the one or more standalone progressive pools, wherein the progressive server is further configured to control a contribution from the wager to at least one group progressive prize pool.

10. The networked gaming system of claim 8 wherein the one or more standalone progressive prize pools include at least two different standalone progressive prize pools and further including, under the control of the one or more processing devices associated with the progressive server, identifying which of the at least two different standalone progressive prize pools are to be increased for the play input.

11. The networked gaming system of claim 10 further including determining if the wager is at a first wager level defined for the wagering game or is at a second wager level defined for the wagering game, the second wager level being different from the first wager level, and choosing which of the at least two standalone progressive prize pools is to be increased based upon which wager level is determined.

12. The networked gaming system of claim 8 wherein a contribution apportionment for the play input determines an apportionment of the respective contribution amount for increasing at least two standalone progressive prize pools for that play input.

13. A program product stored on one or more tangible non-transitory computer readable data storage devices, the program product including:

(a) standalone progressive prize pool control program code executable by the at least one processor associated with a progressive server on a network, and executable to (i) provide an operator interface with an option to configure each of multiple unique gaming machines having a game with a group identifier not unique among the multiple unique gaming machines, associating a respective identifier for the group identifier of each of the multiple unique gaming machines with a respective one of multiple group progressive prize pools, each of the multiple progressive prize pools thereby being linked to at least two of the multiple unique gaming machines; (ii) provide an operator interface with an option to convert two or more gaming machines to standalone progressive functionality by associating identifiers for two or more of the multiple unique gaming machines with respective ones of multiple standalone progressive prize pools;

(b) player input program code executable by at least one gaming processor to receive a player input from a currency or credit acceptor or player card reader of the gaming machine, and in response activate a credit meter showing player credits to be wagered, and receive a play input entered through a player input system of a gaming machine activating a wager of credits;

(c) game program code executable by the at least one processor to cause a result display system of the gaming machine to display a representation of a result for the play input;

(d) progressive prize pool control program code executable for determining whether a standalone progressive contribution event is required for the play input;

(e) wherein the standalone progressive prize pool control program code is further executable under control of the one or more data processing devices associated with the progressive server to, if the standalone progressive contribution event is required for the play input, applying a respective contribution amount to increase at least one of the one or more standalone progressive prize pools, and for awarding a standalone progressive prize from at least one of the one or more standalone progressive prize pools responsive to the occurrence of a standalone progressive prize triggering event; and (f) game payout program code executable by the at least one processor to award any prize associated with the result for the play input, the prize being awarded through the gaming machine and credited to the credit meter.

14. The system of claim 8, in which converting two or more gaming machines to standalone functionality further comprises retrofitting a gaming machine originally programmed to provide a progressive contribution associated with a group identifier to the progressive server, to provide a modified executable code routine in place of an original executable code routine designed to report wager contributions to, when reporting, change the group identifier to be a unique gaming machine identifier, enabling a standalone progressive prize pool for the gaming machine.

15. The networked gaming system of claim 8, wherein the instruction are further executable to provide an operator interface allowing an operator to create at least two standalone progressive prize pools associated with at least two respective individual gaming machines by splitting an existing group progressive prize pool.

16. The program product of claim 13, further comprising group progressive prize pool program code configured to control a contribution from the wager to at least one group progressive prize pool.

17. The program product of claim 13, wherein the one or more standalone progressive prize pools include at least two different standalone progressive prize pools and the standalone progressive prize pool program code is further executable for identifying which of the at least two different standalone progressive prize pools are to be increased for the play input.

18. The program product of claim 13, in which converting two or more gaming machines to standalone functionality further comprises retrofitting a gaming machine originally programmed to provide a progressive contribution associated with a group identifier to the progressive server, to provide a modified executable code routine in place of an original executable code routine designed to report wager contributions to, when reporting, change the group identifier to be a unique gaming machine identifier, enabling a standalone progressive prize pool for the gaming machine.

* * * * *